United States Patent [19]

Thaeter et al.

[11] 4,037,823

[45] July 26, 1977

[54] STEAM-DRIVEN TOW LINE WINCH

[76] Inventors: Hans Thaeter, Depkenstr. No. 2, 28 Bremen; Anton Broehl, Postfach 84, 5474 Brohl-Lutzing No. 1, both of Germany

[21] Appl. No.: 548,742

[22] Filed: Feb. 10, 1975

[30] Foreign Application Priority Data

Feb. 13, 1974 Germany ..... 2406718

[51] Int. Cl.[2] ..... B66D 1/10; F15B 11/10

[52] U.S. Cl. ..... 254/172; 91/433

[58] Field of Search ..... 91/433, 446, 448, 468; 137/596, 117; 254/172

[56] References Cited

U.S. PATENT DOCUMENTS

| | | | |
|---|---|---|---|
| 2,982,258 | 5/1961 | Farkas | 91/468 X |
| 3,101,977 | 8/1963 | Hyler et al. | 91/433 X |
| 3,231,241 | 1/1966 | Lottermoser | 254/172 |
| 3,279,761 | 10/1966 | Schreiber | 254/172 |
| 3,654,837 | 4/1972 | Knapp | 91/468 X |
| 3,807,447 | 4/1974 | Masuda | 91/433 X |

*Primary Examiner*—Irwin C. Cohen

*Attorney, Agent, or Firm*—Richards, Harris & Medlock

[57] ABSTRACT

A steam-driven tow line winch includes a pressure control valve in the live steam line of the winch, and is characterized by the fact that the pressure control valve is equipped with a sleeve valve, the sleeve position of which is controlled by the working pressure in the steam winch.

6 Claims, 5 Drawing Figures

STEAM-DRIVEN TOW LINE WINCH

BACKGROUND AND SUMMARY OF THE INVENTION

The invention relates to a steam-driven tow line winch, or a tow winch with apparatus for automatic tension regulation which comprises a pressure regulating valve in the live steam line of the steam winch.

Large sea-going vessels, especially tankers, are moored at their berth with mooring hawsers which on board of the vessel are fastened (spooled) on the drums of tow line winches.

Since as a result of the movements of the ship with respect to the mooring posts (bollards) on land, such as they occur due to changes in the state of loading, under the effect of the tides, in locks or due to swell, the hawsers can be loaded (subjected to stress or strain) to the breaking point, suitable overload safety devices must be provided on the steam winches. But it is also desirable that on removal of the load (stress or strain), the hawsers automatically become taut again.

Every conventional steam winch is suitable for keeping a hawser under tension automatically, i.e., to haul in the hawser when the tension diminishes and to pay out the hawser when the tension increases, without manipulation of the hunting valve. For this purpose, the hunting valve is set for "heaving", and this causes the winch to stop when the pull (tension) of the hawser has reached a level which just balances the steam pressure in the cylinders of the steam winch and thus corresponds to the full nominal tension (line pull).

If the tension (line pull) increases further, the winch at first remains stopped until at approximately double the pull (200% of the nominal tension (line pull)) the internal resistances in the steam engine and drive train have been overcome and the winch is stripped backwards (in reverse) against the steam pressure. The hawser now is paid out, although the running valve of the steam engine is set for "heaving".

If the tension (line pull) falls again, then the winch first stops and starts to heave in again only when the friction losses have been overcome and the pull (tension) of the hawser has dropped below the nominal valve.

It is desired that in the warping operation the manually controlled steam winch performs at the full nominal tension (line pull), but that when the ship is moored this value is exceeded only little or not at all during the automatic pay out, in order to protect the winches and the hawsers. In order to realize these operating conditions, two different designs have been used in the past.

If a slight change in tension (line pull) is required to differentiate between hauling in and paying out of the hawsers, then, if at all possible, the tension (pull) of the hawser should be measured at the steam winch, that is to say at the drum, so that the effect of the efficiency of the winches is eliminated. Suitable load scales are available which transfer the measured value to the control mechanism, i.e., in the case of steam winches to the hunting valve, and thereby control the steam engine at constant tension (line pull) (German Pat. No. 1,231,400). Numerous tow line winches have been equipped with this type of automatic mechanism. But, since the load scale arranged at the drum has to be designed for large torques and forces, it is very expensive. Furthermore, additional elements (parts) are required in order to transmit the impulse of the load scale to the hunting valve while avoiding hunting (pendulum phenomena).

If the main consideration is the limiting of the maximum tension (line pull) during withdrawing (paying out) of the hawsers from the drum, while it suffices to carry out the hauling in with considerably less force, then another known design (German Pat. No. 1,237,754) is suitable, which is simpler and is being used in practice. In this case, during automatic operation a pressure control valve at the exhaust-steam pipe of the steam winch becomes active, which dams up the counter pressure (back pressure) in the cylinders to the extent that the differential pressure effective at the pistons amounts to approximately half of the pressure required for the nominal tension (line pull). The hauling in of the hawsers thus takes place with half the tension (line pull), while the paying out takes place approximately with the nominal tension (line pull) for which the steam winch is designed at manual control. This manner of operation of the (pressure) control valve is obtained by the fact that an adjusting piston acted upon (actuated) by the live steam forces the valve cone at the exhaust steam outlet against its seat. Since the valve cone has twice the area of the adjusting cone, the outlet remains closed as long as the counter pressure (back pressure) in the machine lies below half of the live steam pressure, but is opened when the counter pressure rises above half of the live steam pressure. The disadvantage of this type of design is that in automatic operation the differential pressure, and thereby the tension (line pull), changes when the live steam pressure fluctuates. A setting for different (selective) tensions (line pulls) is not possible, since the construction of the pressure control valve is meant only for a fixed ratio of live steam pressure to counter pressure.

Also known (German Pat. No. 1,124,652) is the installation of a pressure control valve in the live steam line of the winch and this pressure control valve keeps any arbitrarily set pressures in the steam engine constant. In order to prevent in the stopping position or when the hawsers are being pulled off (paid out) the pressure rising above the desired value caused by unavoidable leaks in the (pressure) control valve and by compression during backwards (reverse) turning of the steam engine, a relief valve is provided so that the steam can blow off to the exhaust steam line. In this arrangement, however, the setting of pressure control valve and relief valve to points of response which differ only little from each other, causes difficulties, and the condition is quite likely to occur in which steam flows off to the exhaust steam line when this is not desired at all.

The object of the present invention is to avoid the difficulties present in the known steam-driven tow line (mooring) winches and tow winches and to design the device for automatic tension (line pull) regulation in such a way that faulty response of the device is prevented with certainty and exhaust steam losses (wastes) are prevented at the same time.

According to the invention, this object finds its solution in the fact that the pressure control valve is equipped with a sleeve valve, the sleeve position (slide position) of which is controlled by means of the working pressure in the steam winch. The advantage obtained is that the control of the live steam pressure and the overflowing of steam to the exhaust steam line are both effected by the same device and thereby necessarily are made dependent on each other.

In a preferred embodiment of the invention, the pressure control valve (pressure regulator) has a sleeve valve which is acted upon from both sides and which is designed as a differential (pressure) piston, with the piston surface being acted upon by the live steam pressure exhibiting a smaller cross section than the opposite piston surface being acted upon by the working pressure in the winch. If a ratio of about 1:2 is selected for the cross sections of the piston surfaces of the sleeve valve, then the live steam passage to the hunting valve of the steam winch is completely open when the live steam pressure in the steam supply is more than twice as high than the working pressure in the steam winch. On the other hand, the passage to the hunting valve of the steam winch is completely closed when the live steam pressure lies below twice the value of the working pressure. The sleeve valve of the pressure control valve (pressure regulator) will automatically adjust itself to a position in which just the right amount of live steam is always released so that the working pressure is reduced to one half the live steam pressure.

The pressure control valve (pressure regulator) advantageously includes a passage to the exhaust steam line, which connects the steam winch with the exhaust steam line when the sleeve valve is in the closed position. Furthermore, steam chokes can be installed in the control line of the pressure control valve (pressure regulator).

In a further aspect of the invention, the sleeve valve of the pressure control valve (pressure regulator) can be loaded on one side by the working pressure of the steam winch and on the other side, instead of being loaded by the live steam pressure from the steam supply, can be loaded against the working pressure of the steam winch by means of a spring. This provides an adjustment for constant working pressure, this adjustment being independent of pressure fluctuations in the steam supply. Moreover, by changing the spring tension, this constant working pressure is infinitely adjustable to any desired magnitude. A further advantage results when the spring-applied piston side of the sleeve valve is acted upon (via an orifice) by the pressure in the exhaust steam line of the winch, since this pressure can also fluctuate in practice. By so doing, the differential pressure in the cylinders of the steam engine, which is decisive for the tension (line pull) of the winch, is adjusted to a constant value.

In an especially advantageous embodiment of the invention it is furthermore possible instead of using a separate pressure regulator, to utilize the hunting valve (which is present anyway on the steam winch) as a sleeve valve for the control of the steam pressure in such a manner that the hunting valve of the steam winch can be adjusted by means of a regulator piston which works against the force of a spring and which can be acted upon (actuated) by the working pressure of the steam winch, namely on a piston surface opposite the spring.

DESCRIPTION OF THE DRAWINGS

Further details and advantages of the invention will be understood from the examples of the invention which are schematically represented in the drawings, wherein.

DETAILED DESCRIPTION

Figure 1:
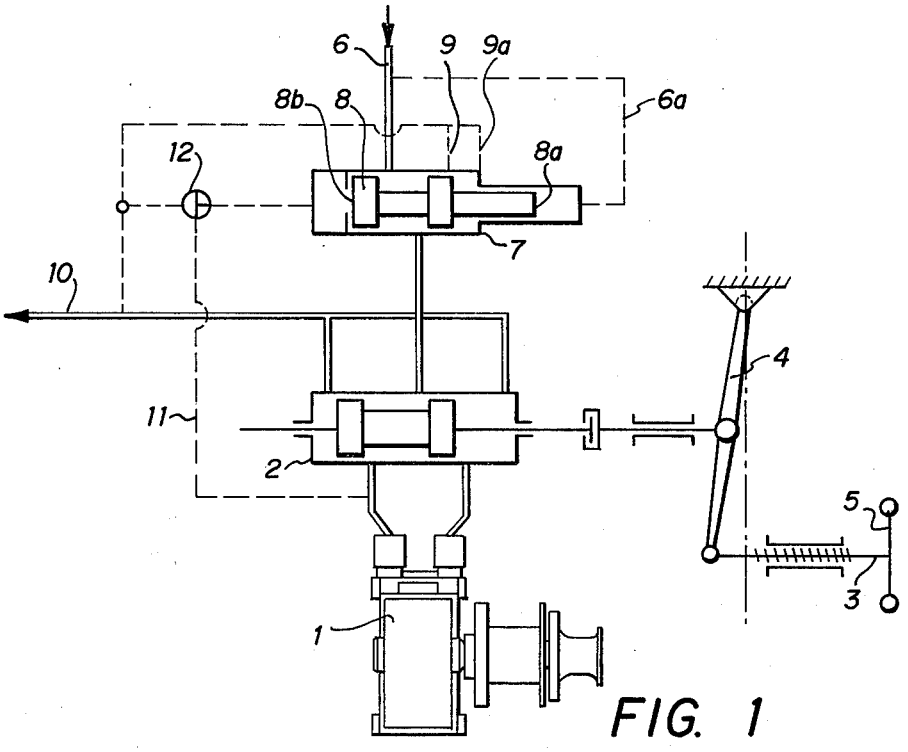
FIG. 1 shows a steam-driven tow line winch (mooring winch) with a device, designed as a main connecting device, for automatic tension (line pull) control in a first embodiment of the invention.

FIG. 1 schematically shows a conventional winching drum operated by a steam-driven motor 1 with an associated hunting valve 2 which can be actuated (operated) by means of a hand wheel 5 via a spindle 3 and a lever 4. For automatic warping operation (line tensioning) the hunting valve 2, as shown in FIG. 1, is completely set on "heaving" by adjusting lever 4 by means of hand wheel 5. The live steam, however, instead of flowing directly through live steam line 6 from the steam supply to the hunting valve 2, flows via a pressure control valve (pressure regulator) 7 which is connected in series at the inlet side of the hunting valve.

The pressure control valve 7 contains a sleeve valve 8 which on one hand (side) is acted upon (actuated) by the live steam pressure from the steam supply via line **6*a* and on the other hand (side) is acted upon (actuated) by the working pressure in steam winch 1. If piston areas 8*a*, 8*b* of sleeve valve 8 are selected to be different, for instance in the ratio of 1:2, then the live steam passage from live steam line 6 to hunting valve 2 is completely open when the pressure in the steam supply amounts to more than double the working pressure in steam winch 1. On the other hand, the passage to hunting valve 2 is completely closed off when the live steam pressure lies below twice the value (of the working pressure in steam winch 1). Sleeve valve 8 of pressure control valve (pressure regulator) 7 will (automatically) adjust itself to a position in which just the right amount of live steam is always released so that the working pressure in steam winch 1** is reduced to one half of the live steam pressure.

Since when the steam winch 1 stands still (is at rest) and has no steam consumption, in spite of a closed off live steam line 6, steam can nevertheless escape into the cylinders of steam winch 1 because of leakage at sleeve 8, the steam pressure in the cylinders of steam winch 1 would gradually rise if, likewise due to leakage, the same amount of steam does not continue to flow on further or condense on the walls of the cylinders and lines. In addition, it would be possible that even when the live steam is completely shut off and the steam winch is turned backwards (in reverse), the compression pressure in the cylinders of the steam winch rises too high under the effect of increasing pull of the hawsers (line pull). This undesirable condition can be avoided if after movement into its shut-off operation, sleeve valve 8 opens a passage 9 to the exhaust steam line 10, which connects the steam winch 1 with exhaust steam line 10. An additional, constantly open connection **9*a* to the exhaust steam line 10 prevents a pressure build-up in the closed-off part of pressure control valve (pressure regulator) 7 due to leakiness of the sleeve valve 8**.

It is advisable to install chokes in the control lines for pressure control valve (pressure regulator) 7 since, particularly because of the pulsating flow of steam to steam winch 1, vibrations in pressure control valve (pressure regulator) must be provided for. By switching control line 11 from steam winch 1 to exhaust steam line 10 by means of a three-way cock (selector valve) 12 provided in control line 11, pressure control valve (pressure regulator) 7 can be put out of operation, because sleeve valve 8 then always remains pushed into the end position in which the path for the live steam is left completely free (open). Steam winch 1 can then be operated manually by means of hunting valve 2.

Figure 2:
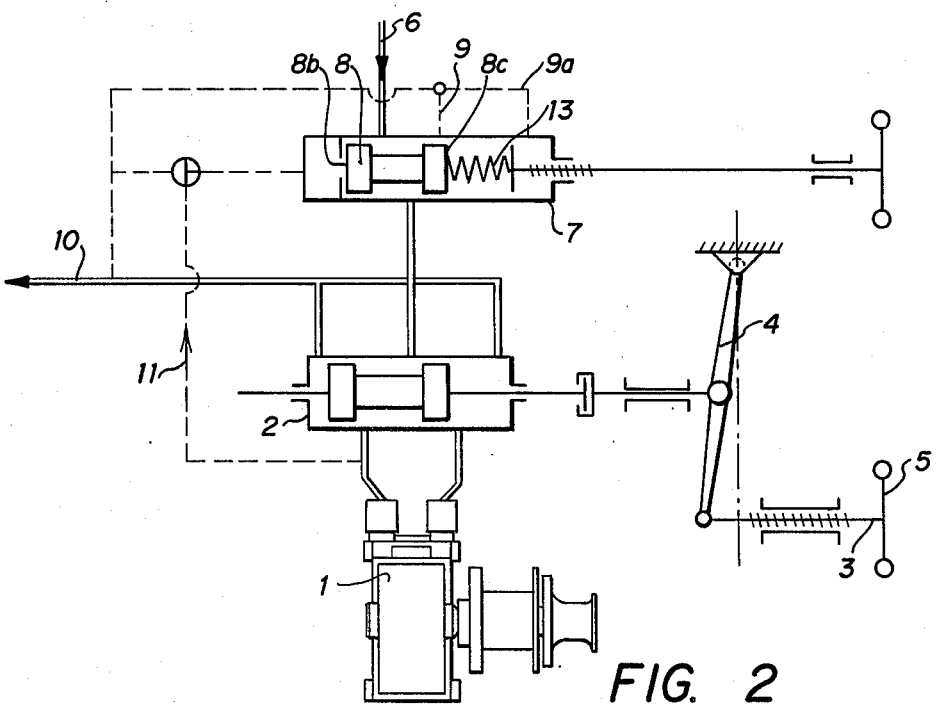
FIG. 2 shows a second embodiment which is a variation of FIG. 1.

FIG. 2 shows an improved embodiment of pressure control valve 7 which is connected in series at the inlet side. In principle, the functioning of pressure control valve 7 is similar to the one in FIG. 1, except that while one piston surface 8*b* of sleeve valve 8 is acted upon (actuated) by the working pressure of steam winch 1, the other piston surface instead of being acted upon by the live steam pressure from the steam supply is loaded by a spring 13. An adjustment of the device for constant working pressure, which is independent of the pressure fluctuations in the steam supply, is thereby obtained. Moreover, by changing the spring tension of spring 13, this constant working pressure is infinitely adjustable to any desired magnitude. Furthermore, it is possible, via a connection 9*a*, to cause the spring-applied piston surface 8*c* of sleeve valve 8 to be acted upon by the pressure of exhaust steam line 10, which in practice can fluctuate also. By doing so, the differential pressure in the cylinders of the steam engine, which is decisive for the tension (line pull) of steam winch 1, is adjusted to a constant valve.

Figure 3:
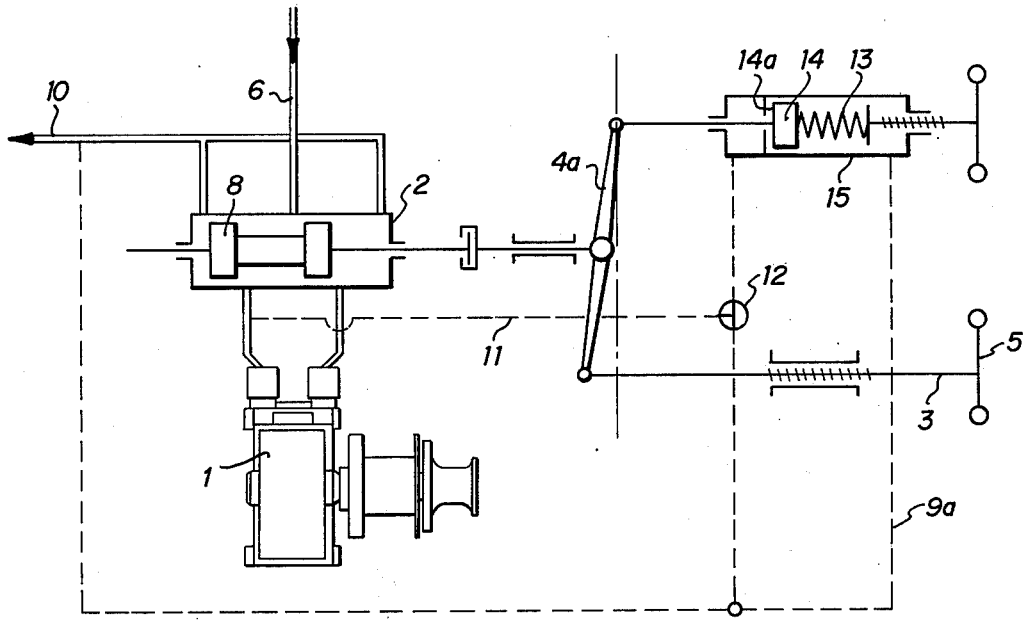
FIG. 3 shows an additional embodiment.

According to FIG. 3 of the drawing, hunting valve 2 of steam winch 1 is not arrested in the fully open position, but it is used as sleeve valve 8 for the regulation of the steam pressure in steam winch 1. For this purpose, the valve can be adjusted via a differential lever 4a not only by hand but also by means of a regulator piston 14 which works against a spring 13. The automatic working process is initiated by first setting the hunting valve 2 on full opening by means of spindle 3 actuated by hand wheel 5. The cross section of the opening then is again reduced by regulator piston 14 until the working pressure in steam winch 1 balances the force set in regulator 15 by means of spring 13. If when the steam winch 1 stands still, as discussed above in connection with FIG. 1, an undesirable pressure rise should occur, then hunting valve 2 can even be moved such a distance that the live steam connection and the exhaust steam connection to the cylinders of steam winch 1 are interchanged.

In this case as well, the effective differential pressure is kept constant; vibrations of regulator piston 14 can be prevented by means of chokes in control line 11 and the working manner of regulator 15 can be interrupted (discontinued) if a three-way cock (selector valve) 12 connects the control line 11 with exhaust steam line 10. The spring-applied piston surface of regulator piston 14 is continually loaded (acted upon by the pressure in exhaust steam line of the steam winch via a connection 9*a*.

Figure 4:
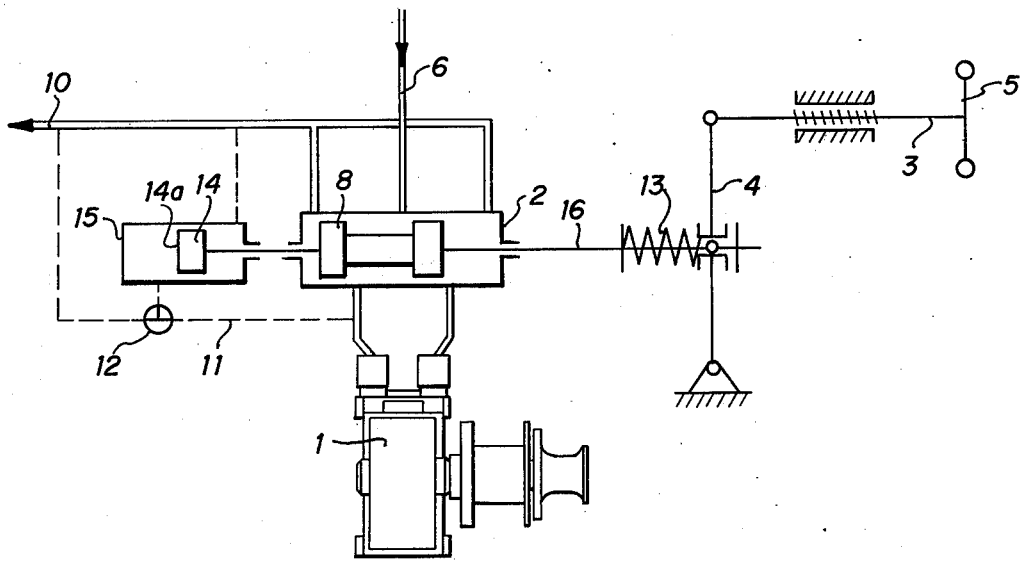
FIG. 4 shows a simplified version of FIG. 3.

FIG. 4 shows a simplified embodiment of FIG. 3 in which regulator piston 14 does not engage sleeve valve 8 of hunting valve 2 of FIG. 3 via a differential lever (compound lever), but is arranged (together) with sleeve valve 8 on a common piston rod 16 which at the extremity away from regulator piston 14 by means of spring 13 is urged by spring action against the adjusting device for hunting valve 2. This arrangement, moreover, works just like the arrangement based on FIG. 3.

Figure 5:
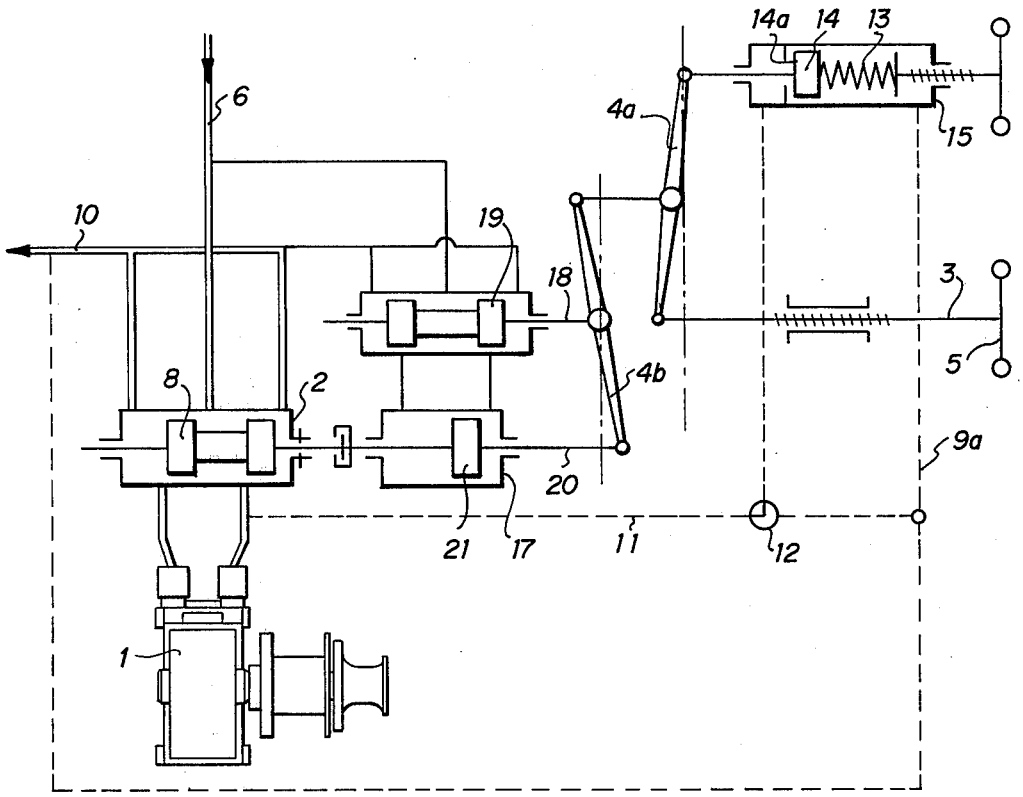
FIG. 5 shows a further development of FIG. 3.

In FIG. 5 the embodiment according to FIG. 3 is shown with the interposition of a (steam) power amplifier 17 constructed as a steam servo apparatus for the actuation of hunting valve 2. The regulator piston 14, which in this case as well is loaded by a spring 13 against the working pressure in steam winch 1, in this case does not act directly via differential lever (compound lever) 4*a* on sleeve 8 of hunting valve 2, but instead via an additional differential lever (compound lever) 4*b* and the steam servo apparatus which are connected ahead of the hunting valve 2. Differential lever (compound lever) 4*b* is mounted in seesaw fashion on piston rod 18 of the reversing cylinder 19 of the steam servo apparatus, and at its downward directed extremity it is connected in articulated fashion with piston rod 20 of (steam power) amplifier piston 21 of the steam servo apparatus. As compared to the form of embodiment represented in FIG. 3, nothing is thereby changed in the functioning of the device, but regulator piston 14 and spring 13 of regulator 15 can be designed for smaller forces.

Although preferred embodiments of the invention have been illustrated in the drawings and described in the foregoing specification, it will be understood that the invention is not limited to the embodiments disclosed, but is capable of numerous rearrangements, modifications, and substitutions of parts and elements without departing from the spirit of the invention.

What is claimed is:

1. In a winch system of the type including a tow line winch actuated by a steam-driven motor, a live steam line for supplying steam for operating the motor, an exhaust line, and a hunting valve for controlling the direction of steam flow from the live steam line through the motor to the exhaust line and thereby controlling the direction of operation of the winch, the improvement comprising:

a pilot operated pressure control valve having a pilot port and connected between the live steam line and the inlet port of the hunting valve;

a pilot line connecting the working pressure of the steam-driven motor to the pilot port of the pressure control valve and thereby actuating the pressure control valve toward a first position;

a three-way cock in said pilot line having one position for connecting the working pressure of the motor to the pilot port and another position for connecting the working pressure of the motor to said exhaust line whereby the pressure control valve is put out of operation; and means for applying a predetermined bias to the pressure control valve and thereby actuating the pressure control valve toward a second position;

so that the flow of steam from the live steam line through the pressure control valve to the hunting valve depends upon the ratio between the working pressure of the steam-driven tow line winch and the predetermined bias.

2. The improvement according to claim 1, characterized by the fact that the pressure control valve has a passage to the exhaust steam line which connects the steam winch with the exhaust steam line when the pressure control valve is in the first position.

3. The improvement according to claim 1 wherein the means for applying a predetermined bias comprises a second pilot port in the pressure control valve, and means connecting the steam pressure within the live steam line to the second pilot port of the pressure control valve.

4. The improvement according to claim 3 wherein the pressure control valve is further characterized by opposed piston surfaces, with the piston surface that receives the working pressure of the steam-driven tow line winch being larger in cross section than the piston surface which receives the pressure from the live steam line.

5. The improvement according to claim 4, characterized by the fact that the ratio of cross sections of the piston surfaces of the pressure control valve is about 1:2.

6. The improvement according to claim 1, characterized by the fact that the means for applying a predetermined bias comprises a spring against the working pressure of the steam winch.

* * * * *